US010045103B1

(12) United States Patent
Mason et al.

(10) Patent No.: US 10,045,103 B1
(45) Date of Patent: Aug. 7, 2018

(54) KINESTHETIC SPEAKER SYSTEM AND METHOD OF USE

(71) Applicants: Stephen Mason, Trenton, GA (US); Scott Geller, Atlanta, GA (US)

(72) Inventors: Stephen Mason, Trenton, GA (US); Scott Geller, Atlanta, GA (US)

(73) Assignee: Stephen Mason, Trenton, GA (US)

( * ) Notice: Subject to any disclaimer, the term of this patent is extended or adjusted under 35 U.S.C. 154(b) by 0 days.

(21) Appl. No.: 15/386,727

(22) Filed: Dec. 21, 2016

Related U.S. Application Data

(63) Continuation-in-part of application No. 14/568,609, filed on Dec. 12, 2014.

(60) Provisional application No. 61/916,945, filed on Dec. 17, 2013.

(51) Int. Cl.
*H04R 1/28* (2006.01)
*H04R 1/02* (2006.01)
*H04R 1/34* (2006.01)

(52) U.S. Cl.
CPC ..... *H04R 1/025* (2013.01); *H04R 1/345* (2013.01); *H04R 2201/023* (2013.01); *H04R 2420/07* (2013.01); *H04R 2460/13* (2013.01)

(58) Field of Classification Search
CPC ..... H04R 2499/11; H04R 1/00; H04R 17/00; H04R 9/06; H04R 7/16; H04R 9/025; H04R 1/345
USPC ..... 381/345, 162, 398, 412, 338
See application file for complete search history.

(56) References Cited

U.S. PATENT DOCUMENTS

| | | | | |
|---|---|---|---|---|
| 4,020,284 | A * | 4/1977 | Phillips | H04R 1/32 381/2 |
| 4,501,934 | A * | 2/1985 | Wiener | H04R 1/02 181/153 |
| 2005/0117766 | A1* | 6/2005 | Ito | H04R 1/2849 381/333 |
| 2007/0217644 | A1* | 9/2007 | LeDonne | A61H 23/0236 381/396 |
| 2014/0056461 | A1* | 2/2014 | Afshar | H04R 1/00 381/385 |

* cited by examiner

*Primary Examiner* — Rasha Al Aubaidi
(74) *Attorney, Agent, or Firm* — Stephen J. Stark; Miller & Martin PLLC

(57) ABSTRACT

A kinesthetic speaker usage system provides a speaker connected to a housing about a cavity into which the sound from the speaker is directed. The housing has an exterior surface in tactile communication with a retainer which can direct vibration directly or directly to a user, such as a person. Many embodiments utilize a pipe for the housing, such as a flexible pipe.

20 Claims, 7 Drawing Sheets

KINESTHETIC SPEAKER SYSTEM AND METHOD OF USE

CLAIM OF PRIORITY

This application is a continuation in part of U.S. patent application Ser. No. 14/568,609 filed Dec. 12, 2014 which claims the benefit of U.S. Provisional Patent Application No. 61/916,945 filed Dec. 17, 2013, both of which are incorporated herein by reference in their entirety.

FIELD OF THE INVENTION

The present invention relates to kinesthetically directed speakers and method of their use and more particularly towards speakers directing sound into enclosed environments which are intended to be in tactile contact with an individual so that not only is the auditory sound audible, but it can also be felt through a range of frequencies.

BACKGROUND OF THE INVENTION

Shaking bass response speakers have been known for many years. These speaker systems are often utilized in the home theater market and are typically configured to be connected to furniture such as home theater seats so that upon receipt of a sound of a low frequency such as 20 to 80 or 100 Hz, not only does the speaker normally provide sound at that level but it also physically shakes the seat. Not only do these speakers work well for movies such as those with amplified bass sounds but they also work well with video games, particularly those with loud bass noises to provide enjoyable kinesthetic experiences. These type features have become so commonplace that at the lower end they are quite inexpensive. The design of these speakers are typically no more than about 2-3 inches tall and 4 to 8 inches in diameter.

An improvement over this basic design are tactile transducer speakers such as the TST429 made by Clark Synthesis. These transducer speakers are described by the manufacturer as being originally developed for military and commercial training simulators and provide an extended frequency response over simple bass shaker speakers which typically stop shaking above about 100 Hz. Instead of these high end tactile transducers can impart vibrations over a frequency range of 5 Hz to 17 kHz which covers much of the audio range of humans. These speakers are also limited in construction to about 8 inches diameter and a height up to and less than 2½ inches. These speakers are designed to be connected to a high end home theater furniture, theater risers, platforms, floors, simulators, gaming systems and pro-sound equipment to shake those structures.

The retail price of these speakers currently exceeds $500 a piece online, but are an excellent quality product.

A need exists to be able to bring the kinesthetic speaker sensation of high end audio to the masses.

Another need exists to bring the kinesthetic feel over and above the bass shaker speaker technology (i.e., with frequencies over about 100 Hz) to the consumer.

Another need exists to bring shaker speakers to the portable speaker environment for at least some embodiments.

SUMMARY OF THE INVENTION

It is the present object of many embodiments of the present invention to provide a kinesthetic experience in combination with an audio speaker.

It is another object of many embodiments of the present invention to provide an improved portable kinesthetic and/or tactile speaker.

It is another object of the present invention to provide an improved kinesthetic and/or tactile speaker for use over a relatively wide frequency range.

Accordingly, in accordance with the presently preferred embodiment of the present invention, a kinesthetic and/or tactile speaker system and method provides at least one speaker directing audio frequencies into an enclosed space such as a flexible tube. For many embodiments the opposite end of an enclosed space of air is sealed such as by providing two speakers opposite one another in an enclosed flexible pipe. Alternatively, for at least some embodiments, a speaker directs audio into the cavity of the flexible tube which is preferably a contained space or cavity. For some other embodiments, it may be possible to have only one speaker directing audio into the tube with an opposite end closed off. This same technology could be utilized to direct sound into a cavity such as of a mattress, a cushion, a bar, etc. Of course, multiple speakers could be utilized for these embodiments as well.

In the presently preferred embodiment, two speakers, one opposite another about a flexible pipe are provided with a flexible pipe such as a 3-inch inner diameter corrugated style pipe which (at least the prototype) has been taken from the flexible drain market and provides one of expandable capabilities so that the kinesthetic speaker system can be placed in various contact positions with the body of an individual or animal to enhance the listening experience. While a corrugated expanding collapsing style drain pipe has been effective, other flexible piping or other cavity based systems may also be desirable for other embodiments. Furthermore, non-flexible piping structures may be useful such as directing sound internal to a hollow bar such as could be utilized as a ballet rail or other structure which is intended to be grasped by users.

The system could be utilized internal to furniture such as chairs and other structures. The system could also be used in backpack construction or even various clothing articles or other items in tactile contact with a person.

The applicant has discovered that rather than having to enter high end audio options in order to feel the sound above bass frequencies of 100 Hz, a relatively inexpensive system can be developed as compared to the higher end systems for achieving the tactile or kinesthetic feel of sound at higher frequencies on various portions of the body. Furthermore, some embodiments employ the use of visualizers or time lighting response equipment so that not only is a sound felt and heard, it can also be seen. Further embodiments may be developed with the ability to release aroma therapy based on sound signals to further enhance the desired feel to further enjoy the experience.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
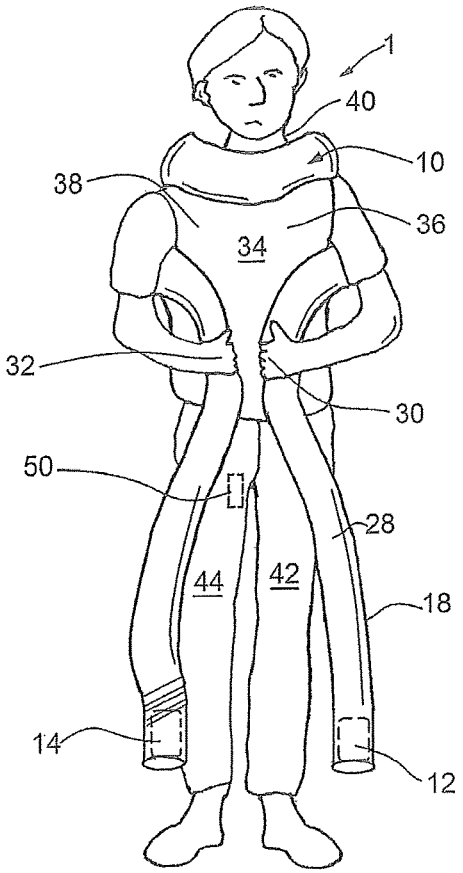
FIG. 1 is a front perspective view of an individual holding a presently preferred embodiment of the present invention.
Figure 4:
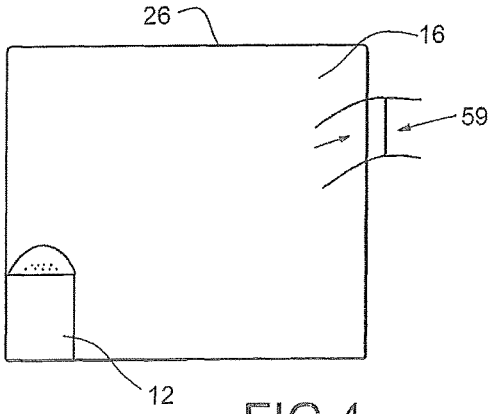
FIG. 4 is a cross-sectional view of a cushion to utilize the technology shown in FIGS. 1-3.

FIG. 1 shows an individual 1 holding a kinesthetic speaker 10 of a presently preferred embodiment. Kinesthetic speaker 10 preferably includes at least a first audio speaker 12 having a cone 11 normally in a cabinet 13 with a sound directed proceeding through cone 11 and out cabinet 13 if not at least first and second audio speakers 12,14 which direct sound internal to a cavity 16 which may be in the form of a housing illustrated as a flexible pipe 18 and/or other pipe such as rigid pipe 20 having a cavity 16 therein and/or pipe 22 such as internal to a mattress 24. Cavity 16 may also be internal to a cushion 26 as will be discussed in further detail in reference to FIGS. 4 and 5 below.

As shown in FIG. 1, a pipe 18, if utilized, provides an exterior surface 28 which can be contacted by the hands 30,32 of the individual 1 and/or put against the body 34 such as around the chest 36, against the back, shoulders 38, neck area 40, legs 42,44, etc. The exterior surface 78 is preferably in direct or indirect, non-aural contact with the living organism (i.e., not against the ear of a person or animal like a headphone). Various lengths of the pipe 18 could be provided as well as diameters. A diameter of less than about 12 inches, less than about 6 inches and even about four inches has been found desirable. Embodiments have been tested satisfactory with a diameter of about one inch.

Flexible pipe 18, if utilized, can take a variety of configurations as are known in the art having a known length or expandable such as through the use of a recreational vehicle drain pipe type construction which has a coiled layer 46 internal a corrugated and expanding PVC layer 48 such as is sold under the brand name Polychute® or others such as the sewer drain hose sold by United States Hardware under SKU216075 and sold by Essential Hardware at essentialhardware.com and/or others. Metal or plastic or other coils could assist in forming the coiled layer 46 for some embodiments. Other pipe 18 may be more or less similarly constructed like corrugated plastic pipe. Length of pipe 18 are preferably at least three times the diameter if not 4, 5 or 10 times the diameter or more. Up to and even over 20 times the diameter has worked well for some embodiments.

Exterior surface 28 could take a variety of forms, such as being covered in fabric, a mesh, such as for use with skin conditioning, etc., or other materials of various textures as may be desired based upon the desires of the embodiment as long as the sound from the void or cavity 16 can be transmitted through structure into the body of the person.

Other pipe styles such as hose pipe, tubes of various diameters which preferably receive a speaker such as first and/or second speakers such as first speaker 12 which is preferably Bluetooth enabled to cooperate wireless with a Bluetooth transmitter such as computer transmitter 50 such as is shown in a pocket of the individual 1 which could be a Smartphone having music stored thereon, a music player or other device, as are well known in the art. Furthermore, other devices such as table style computers, laptop computers, table-top computers and/or others and it can be Bluetooth configured to wirelessly connect with speaker 12 as is well known in the art. Of course, wired systems could also be utilized with other embodiments. Presently, only a single speaker 12 can be Bluetooth connected at the same time with a device 50 although it is envisioned that a second speaker 14 may be connected to first speaker 12 such as wirelessly and/or possibly wired such as with wire 52 either internal to cavity 16 and/or external to the pipe 18 as would be understood by those of ordinary skill in the art.

First speaker 12 is shown with exterior surface 54 of case 11 contacting inner surface 56 at first end 64 to at least assist in defining cavity 16 and from cone 11 sound is directed in sound direction 64 through pipe 18 from first end 64 toward sound end 62 in sound direction 64 directs sound oppositely, when utilized. If coiled layer 46 is utilized with metal coils, magnetic influence may be imposed by connectivity magnet 73 to coils in the coil layer 46.

It may be possible for some embodiments that the outer coil 46 could have a wire therethrough which can be utilized to connect to the first speaker 12 to the second speaker 14 for at least some embodiments. As can be seen from FIG. 2, an exterior surface 54 of the speaker 16 such as case 55 preferably contacts an inner surface 56 of the pipe 18 and provides preferably at least a substantially air-tight seal, if not completely air tight, so that the cavity 16 is air tight or at least a significant restriction to airflow for many embodiments. For some embodiments such as embodiments shown in FIG. 6, a plug 58 may be utilized to assist in providing an air tight cavity for at least some embodiments.

Other embodiments may not necessarily be air tight but preferably restrict the flow of air into and out of cavity 15. Still other embodiments may be open at an end of the cavity 16. In the embodiment of FIG. 1 and at least 2 if not 3, a second speaker 14 may provide an exterior surface 60 to assist in at least partially sealing the inner surface 56 of pipe 18 at a second end 62 of the pipe 18 opposite the first end 54.

Although one pipe 22 is illustrated in the mattress 82 it is possible that more than one could be employed with various speakers such as first speaker 12 while driving the various pipes 22. Single or multiple pipes 22 could be used with other structures such as clothing (for instance, jackets, vests, etc.) backpacks, accessories (i.e., belts, hats, etc.), footwear, etc.

Figure 2:
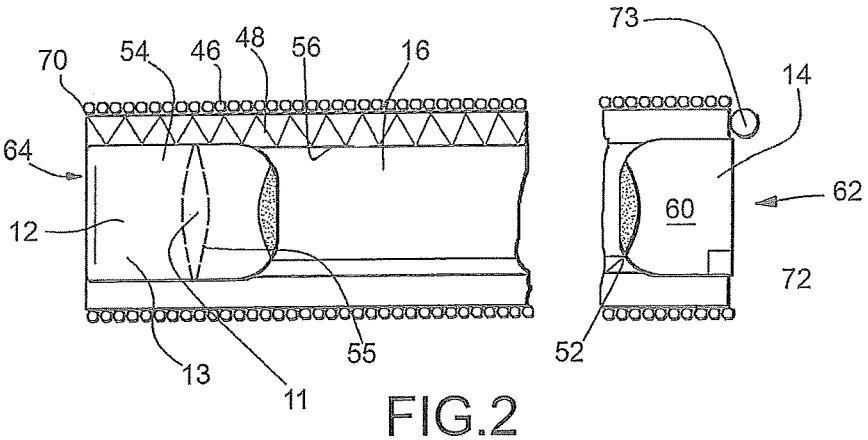
FIG. 2 is a cross-sectional view of the device shown in FIG. 1.
Figure 3:
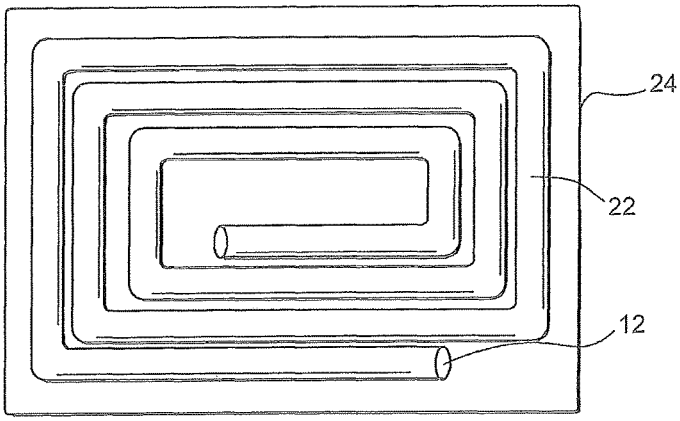
FIG. 3 is a top plan view of the embodiment of FIG. 1 installed in a mattress.
Figure 6:
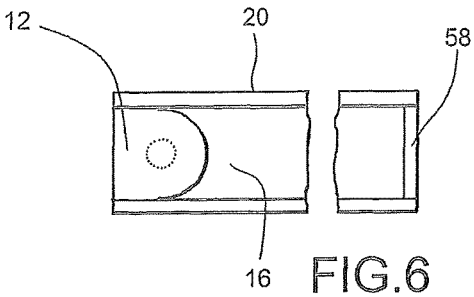
FIG. 6 is a cross-sectional view of the alternatively preferred embodiment of FIG. 2 except incorporated into a rigid structure.

From the embodiment of FIGS. 1 and 2 it should be seen that when an expandable pipe 16 is utilized, when the adjacent coils 46 are pulled apart, the wall thickness is then decreased and the sound level has been found to increase external to the pipe 18 in such a condition. Accordingly, the auditory response can potentially be changed just by expanding the length of the pipe 18. Furthermore, all of the embodiments of FIGS. 1 and 6 show an enclosed cavity. Other embodiments may not enclose the second end 62 for at least some embodiments while still providing a kinesthetic feel to the user while not containing second end 62. A significantly louder auditory response can be provided in such embodiments.

Although currently only one speaker 12,14 is currently connected with the Bluetooth device 50, it is anticipated that with future Bluetooth connections and/or speakers 12,14, it may be possible to wirelessly connect multiple speakers 12,14 together with device 50. It may also be possible to utilize separate Bluetooth connections which is different from connection of the computer or other Bluetooth device 50 which could be a Smartphone, computer, etc., for the multiple Bluetooth connections to be utilized could change over time so the single device 50 could be paired with multiple speakers 12,14 etc., such as by connecting one speaker 12 to another 14 through a separate Bluetooth connection.

Although a coiled corrugated pipe 18 about cavity 16 is the preferred embodiment, other embodiments may take other forms such as a flexible pipe structure which could have a smooth or even a fabric exterior surface. Still other exterior surfaces such as would be known in the art could also be used. Furthermore, a more rigid pipe structure such as pipe 20 and cavity 16 could be utilized for other embodiments as are known in the art such as for a rail, a backpack frame, etc.

Figure 5:
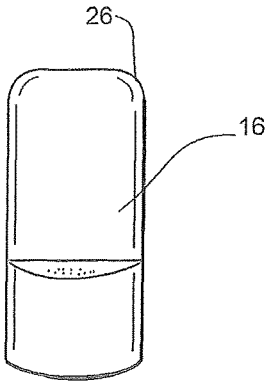
FIG. 5 is a side cross-sectional view of a cushion shown in FIG. 4.

Closed structures such as cushion 26 shown in FIG. 5 could be the back of a chair, the bottom of a chair, etc., may be utilized in which one or more speakers 12,14. Speakers 14 and/or 16 may direct sound internal to the cavity 16 which is preferably at least substantially air tight or at least an enclosed cavity such that the housing or cushion 26 vibrates with the sound directed from the speaker 12 into the cavity 16 over at least a substantial range of frequencies provided by the speaker 12 which would be expected to extend well above the traditional bass shaker speakers which typically quit shaking above 80 or 100 Hz. Although a cushion 26 is illustrated, other structures like backpack frames or other structures could be used with other embodiments. From cushion 26 the vibration could travel through fabric 59 or other structure to user. Remember, the typical audio response of a person extends up to roughly 20,000 kHz. For those constructions sound is directed from the speaker into the cavity 16 which then impacts vibration to the cushion 26 pipe 18 or other structure.

The first embodiment of the applicant may be made to fall well under $100, and could possibly be made to hit a $100 retail price point and certainly well under $200 retail price point as opposed to the expensive tactile transducer type speakers provided by high end audio makers. While the sound quality may be degraded for some embodiments by directing the speaker direction 66 purposely internal to cavity 16, some embodiments may be coupled with additional speakers as to purposely direct sound external to cavity 16 such as by oppositely orienting speakers 12,14 with at least one to direct into internal cavity 16 and another to direct audio external to cavity 16. This may improve the auditory quality that is provided from the second speaker 14 for at least some embodiments. Other embodiments may work differently.

In order to enhance the auditory sound quality while still providing the kinesthetic speaker 10 for the individual due to vibration the auditory sound sends vibration through one or more walls 46,48 of external cavity 16 whether it be through flexible pipe 18 such as through cabinet surface 28 or otherwise, rigid pipe 20, mattress 24 and/or cushion 26 and/or other structure which is intended to be in contact with a living organism such as individual 1. Walls 46 could be in the form of clothing having an internal cavity with sound directed therein, helmets, portions of furniture, flooring, shoes, bedding such as linen, blankets, throws or sleeping bags for adults, piping as illustrated and/or various other options. Contact could be direct from walls 46,48 or indirect such as through sheets or other fabrics.

By draping or wrapping the kinesthetic speaker 10 around one's body or otherwise combining body with material in tactile contact with non-static speaker 18, one feels or senses the sound played by the speakers 12,14 on the body. In fact, the combination or synchronization of audio sound together with the kinesthetic vibration is believed to provide a harmonization effect to the body. Some users may elect to utilize the kinesthetic speaker 10 with ear plugs to purposely not hear the audio to purposely have an altogether different experience. The deaf community may find kinesthetic speaker 10 partially beneficial.

In addition to bodily contact, kinesthetic speaker 10 could be used with plants and/or animals such as to enhance growth or other effects.

In exercise, improvement of posture, and/or other general activities, the kinesthetic speaker 10 may encourage the use or awareness of both left and right sides of the brain, which might otherwise not be as actively involved. Balancing of the body of the individual 1 may need to be more conscious than without the kinesthetic speaker 10. Various exercises, such as respiratory exercises and/or therapy may be aided through the use of kinesthetic speaker 10 such as by sealing one end with a portion of the body of the individual 1 such as over one's nose and/or mouth, etc. When using the mouth and/or nose, inhaling and exhaling may change the response by increasing or decreasing the pressure in the cavity 16 and thus potentially change the kinesthetic experience of the kinesthetic speaker 10.

The kinesthetic speaker 10 could be worn somewhat like a toga or scarf as illustrated. Some embodiments may be constructed sturdy enough to allow one to sit or lay on them. The furniture embodiments like mattress 24 may prove to be relatively easy to incorporate such a structure to accommodate the body's position. Other embodiments may be specifically directed to specific body parts. In fact, infant cribs may utilize kinesthetic speakers 10 with mattresses, bumper pads and/or speaker for baby positioning systems possible to assist a baby to go to sleep.

It will be understood that embodiments may vary in length, vary in inside diameter and/or circumference. Configurations could also accommodate various speaker constructions, different weights and/or different compositions or construction for more or less substantial contact with a human and/or animal body through various activities. It is also envisioned that a light visualizer 70 to conduct lighting could be employed with some embodiments. At least some embodiments may have an odor dispenser which could be coordinated with audio as well.

Although it is anticipated that at least one speaker 12 or 14 will be provided with at least one speaker 12,14 and at least partially enclosed structure having cavity 16, such as flexible pipe 18, rigid pipe 20, mattress 24 and/or cushion 26, flexible pipe 18, rigid pipe 20, mattress 24 and/or cushion 26, other embodiments may provide components to consumers for use without providing the speakers 12 or 14 so that a consumer could use speakers of their choosing.

Figure 7:
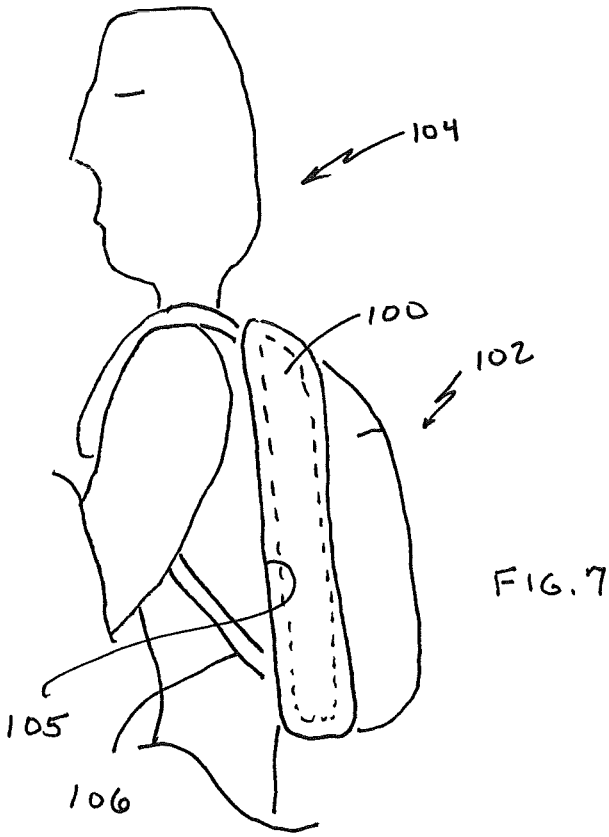
FIG. 7 is a side plan view of a second alternatively preferred embodiment of the invention.
Figure 11:
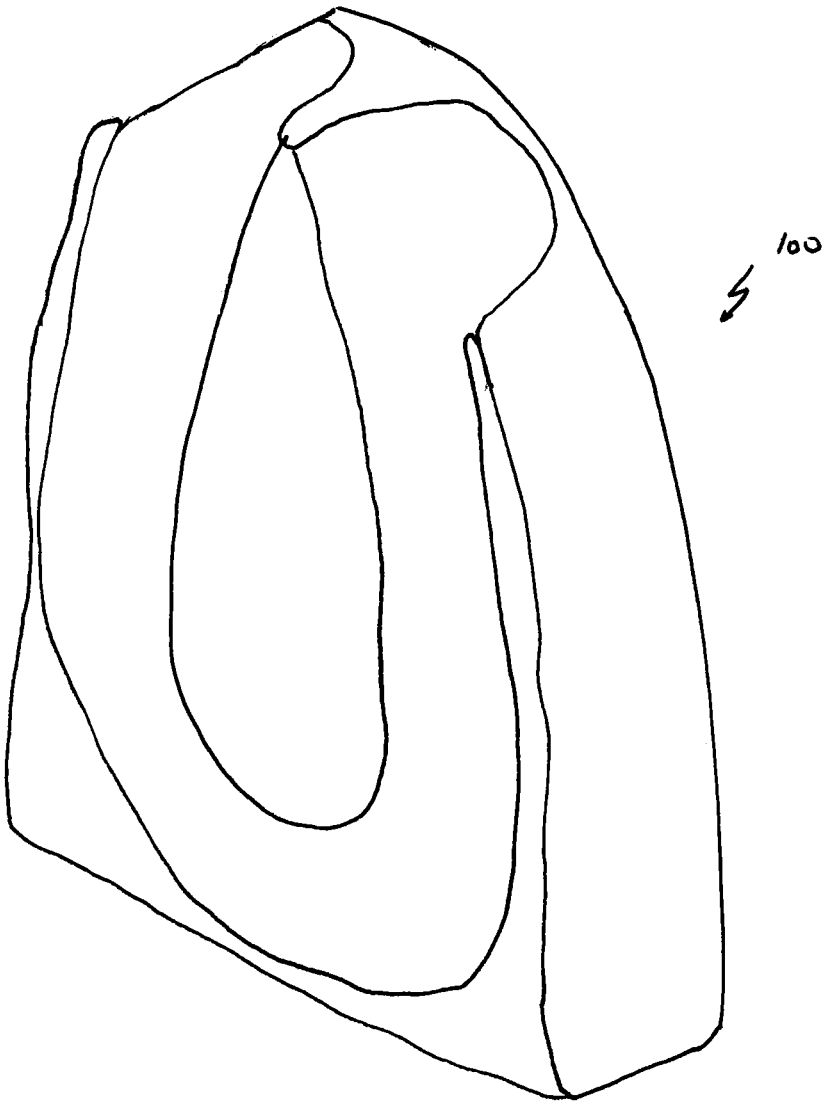
FIG. 11 is a top elevational view of a portion of another embodiment as could be used with FIGS. 7 and 8.
Figure 12:
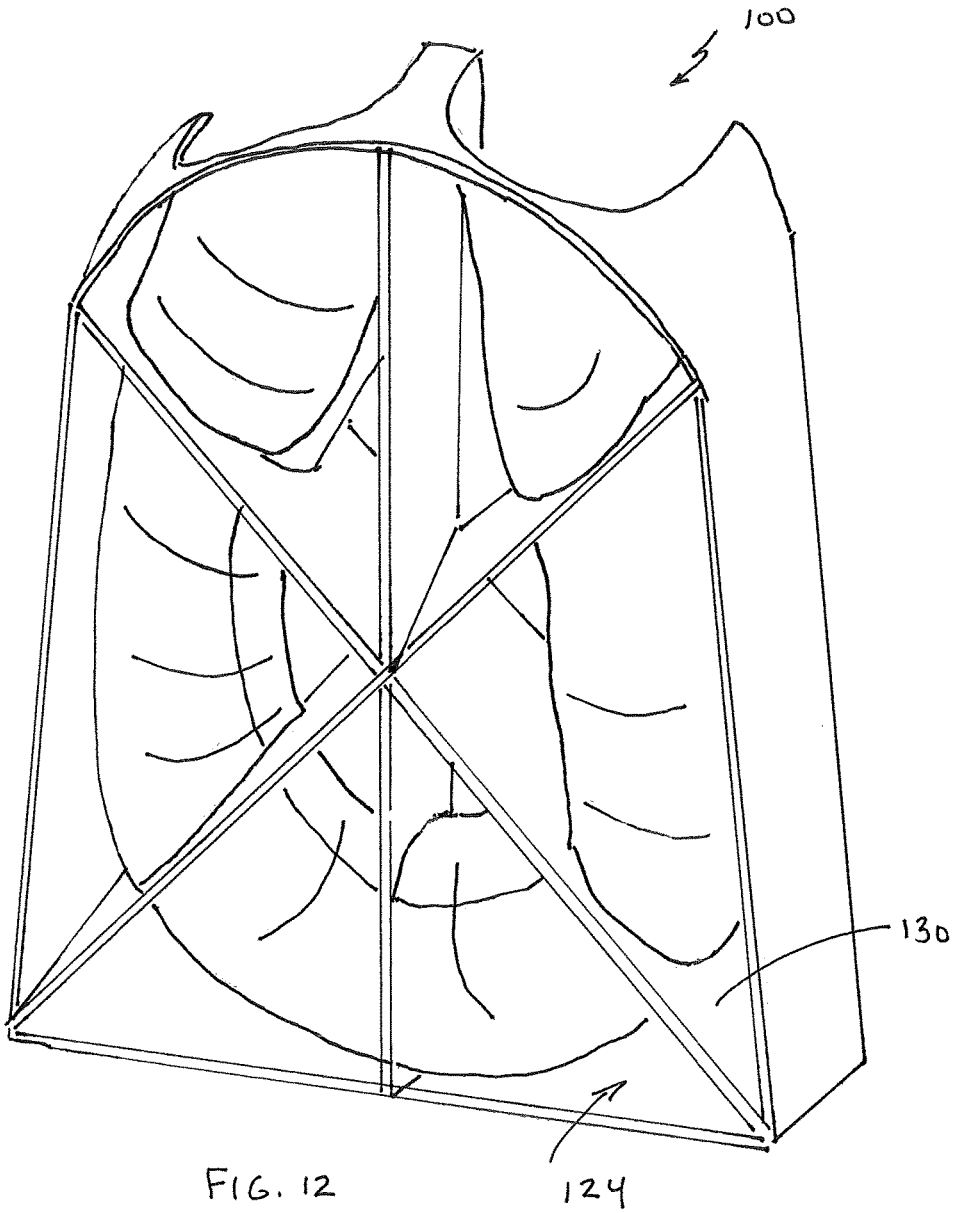
FIG. 12 is a rear view of the portion shown in FIG. 11.

FIG. 7 shows another alternatively preferred embodiment in the form of a retainer 100 located in a backpack 102. The backpack 102 is being worn by a user 104 on their back 105 and one of two straps 106 is shown with the other obscured from view as would be understood by those of ordinary skill in the art. The cushion or retainer 100 has a permanently defined channel 108 configured to receive a flexible tube, such as flexible pipe 18 therein. As shown in FIGS. 9 and 11, the pipe 18 can be in contact with the channel 108 formed into the retainer 100. This way the retainer 100 can transmit vibration through the retainer 100 (either directly or indirectly) to a user 104, such as the back 105 and/or bottom 110 of the user 104 shown in FIGS. 7 and 8 respectively. Other body parts could be targeted with differently constructed retainers 100 using the pipe 18 therewithin.

Figure 8:
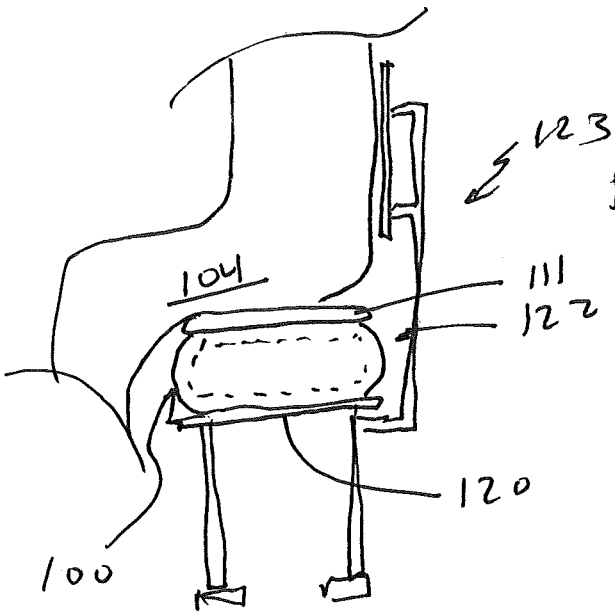
FIG. 8 is a side plan view of a portion of the embodiment shown in FIG. 7 removed and used as a seat cushion.
Figure 9:
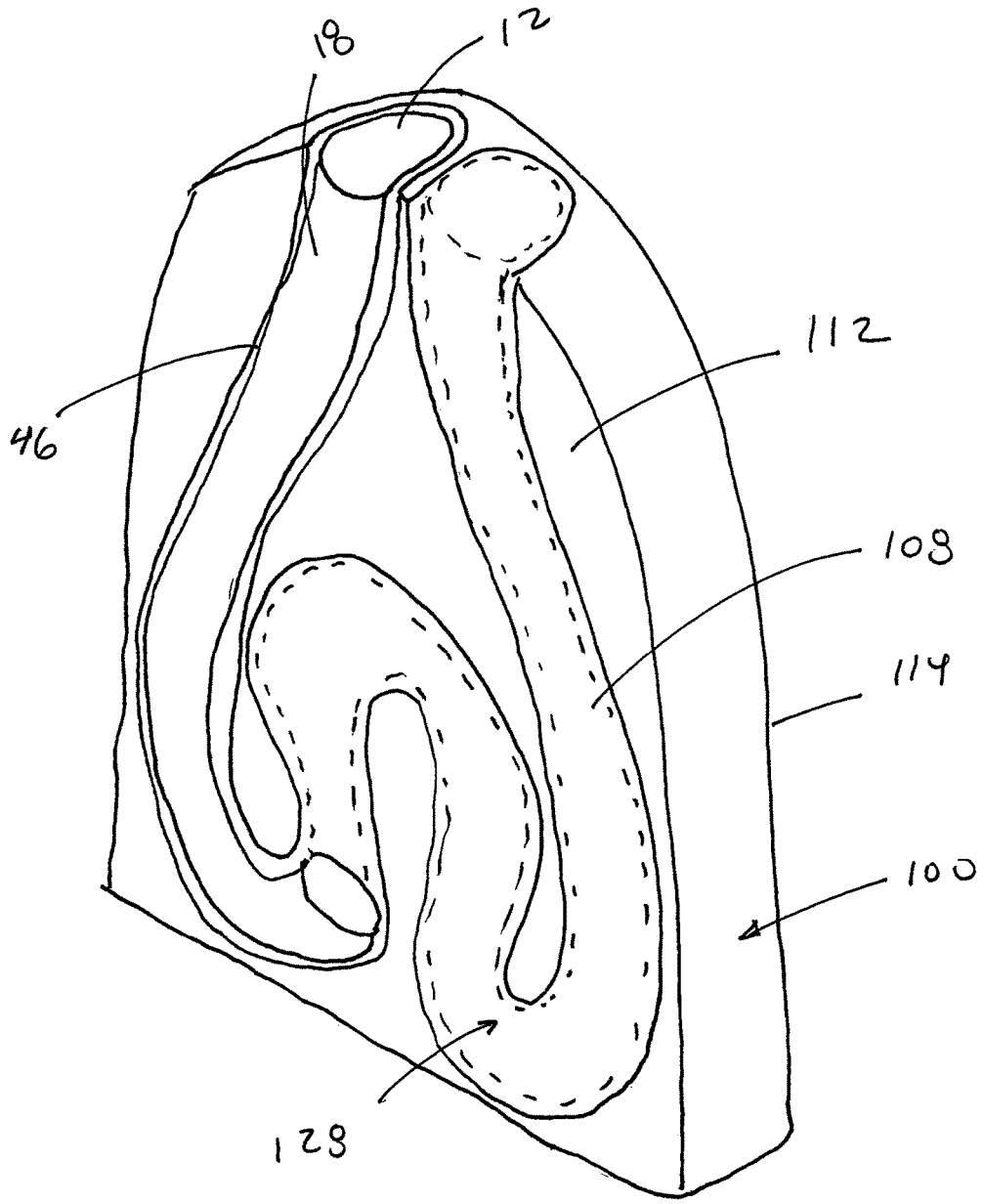
FIG. 9 is a top elevational view of a portion of an embodiment as could be used with FIGS. 7 and 8.
Figure 10:
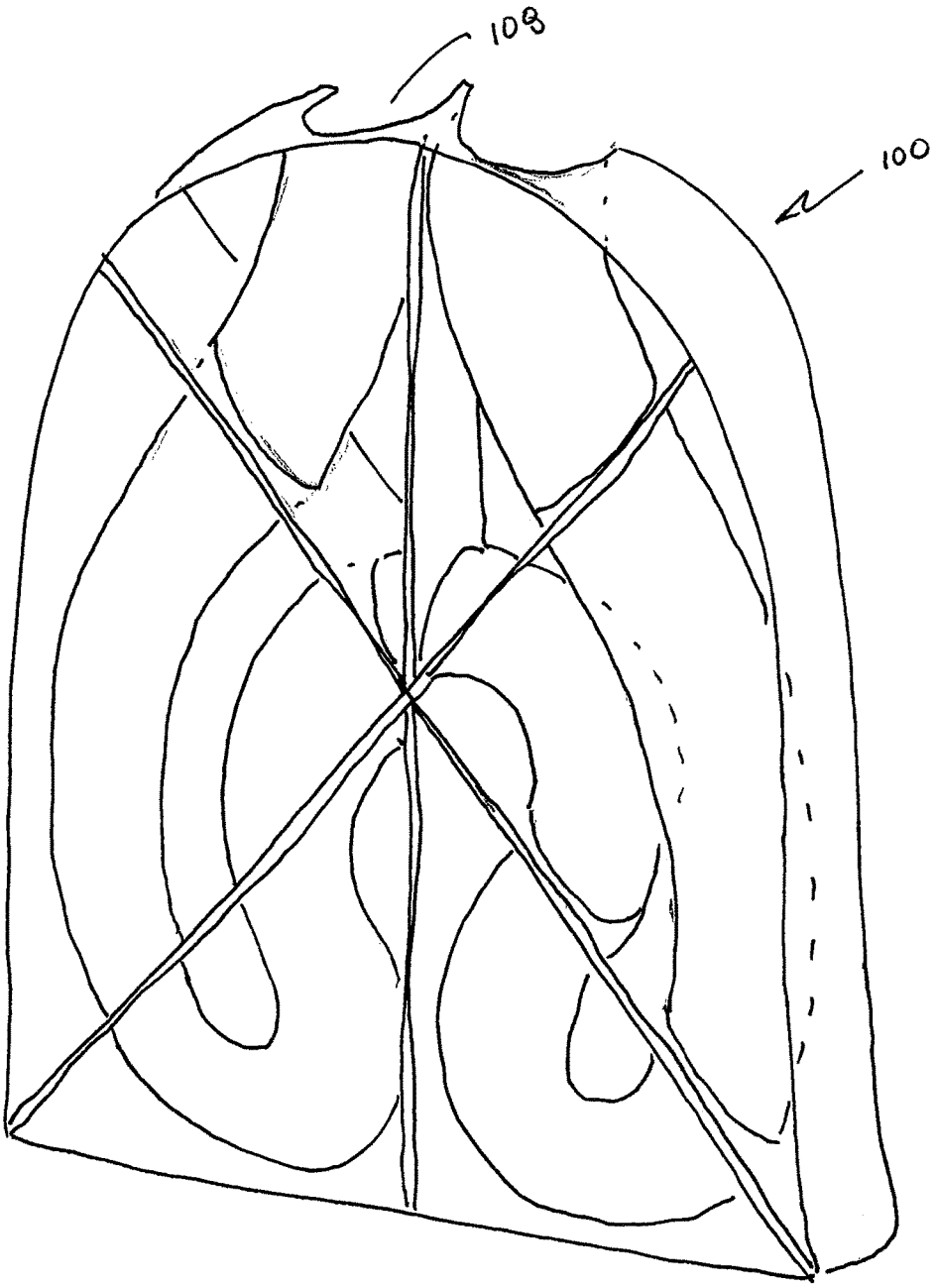
FIG. 10 is a rear view of the portion shown in FIG. 9.

FIG. 8 shows the cushion or retainer 100 taken out of the backpack 102 and placed under the bottom 110 of the user 104. Vibration can proceed from the sides 46 of the pipe 18 and transmit to the channel 108 and then proceed through the retainer 100 to the user 104. A top cover 111 may be useful on which the user 102 sits which is located on top of the retainer 100 as shown. Retainer 100 may prove to be somewhat resilient, like a cushion such as an open cell form and/or other materials, and/or could be a harder structure such as a molded hard plastic or other material of rigid structure.

The channel 108 can have a variety of configurations. FIG. 9 shows a W. FIG. 11 shows a U. Both of these configurations, and others, can help in direct the vibration through body 112 of cushion or retainer 100 to the user 104 and through exterior surface 114 of retainer 100. Pipe 18 can extend the length of the channel 108, or not. Contact from the vibrating pipe 18 to the user 104 is indirect as it must first pass through the retainer 100.

Regardless of the shape of the channel 108, the retainer 100 can have a back portion or body 112 which provides a span to exterior surface 114 which spaces the channel 108 as well as the pipe 18 from contact with the exterior surface 114. The span could be various thicknesses depending upon the embodiment. Also channel 108, for some embodiments may be open, or partially open, to side 128 as shown (or not) for other embodiments to facilitate the insertion of the pipe 18 into the channel 108. Still other embodiments may have the pipe 18 installed into the channel 108 at the factory and need not have a removable pipe 18 configuration as shown with the preferred embodiment. Some embodiments may have a pack portion 124 with ribs 130 which can space the pipe 18 from the exterior surface, or a solid, or semi-solid (such as closed cell foam) could be used with or for the back portion 124. Some embodiments have configurations whereby the pipe 18 can be removed and possibly used as shown in FIG. 1 or others separately from the retainer 100.

For at least some embodiments, the retainer 100 can have multiple applications, such as being sized to fit within a backpack 102 for a first configuration, while also being removable to be able to be used as a seat cushion 122 or other effect on a seat 120, such as a chair 123, or for other purposes.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A kinesthetic speaker system comprising:

a first speaker having a cone;

a housing defining a cavity connected to the speaker, said cavity having an area at least spanning an area circumscribed by a diameter of the cone of the first speaker and said cavity extending a length away from the cone of at least twice as long as the diameter; wherein said housing has an exterior surface configured to transmit sound for tactile communication with a targeted living organism in a non-aural manner;

a retainer provided as an insert and having a body with an elongated channel permanently defined therein along a channel length, said channel receiving the housing therein and there along;

wherein the first speaker imparts vibration to the housing which is thereby communicated through the retainer to a body portion of a targeted living organism through indirect contact therewith in synchronization from the acoustic frequencies as provided by the speaker.

2. The kinesthetic speaker usage method of claim 1 wherein the length of the cavity at least about four times the diameter and the retainer contacts the housing along the length.

3. The kinesthetic speaker usage method of claim 2 wherein the length of the cavity at least about ten times the diameter and the retainer contacts the housing continuously along the channel length.

4. The kinesthetic speaker usage method of claim 1 wherein the housing connected to the speaker further comprises a pipe having at least the diameter of the cone and the channel of the retainer receives at least a portion of the pipe therein.

5. The kinesthetic speaker usage method of claim 1 wherein the speaker provided further comprises a case about the cone, and said case is at least partially disposed in the pipe.

6. The kinesthetic speaker usage method of claim 5 wherein side surfaces of the case are in contact with an interior surfaces of the pipe at a first end of the pipe.

7. The kinesthetic speaker usage method of claim 6 wherein the case forms an air tight seal against the interior surface of the pipe at the first end.

8. The kinesthetic speaker usage method of claim 1 further comprising a second speaker, and wherein the second speaker is oppositely disposed relative to the first speaker relative to the housing.

9. The kinesthetic speaker usage method of claim 8 wherein the housing is a pipe and the first speaker is at a first end of the pipe and the second speaker is at a second end of the pipe.

10. The kinesthetic speaker usage method of claim 9 wherein the second speaker is wirelessly connected to one of the first speaker and an audio source.

11. The kinesthetic speaker usage method of claim 1 wherein the housing is a pipe, and the retainer is in one of a seat cushion and a backpack.

12. The kinesthetic speaker usage method of claim 11 wherein the pipe is a flexible pipe extending throughout the channel of the retainer.

13. The kinesthetic speaker usage method of claim 12 wherein the flexible pipe is an adjustable length pipe.

14. The kinesthetic speaker usage method of claim 11 wherein the first speaker is at a first end of the pipe and a second end opposite the first end is plugged.

15. The kinesthetic speaker usage method of claim 1 wherein said housing and retainer is integrated into one of clothing, bedding, furniture, backpacks, and wearable accessories.

16. The kinesthetic speaker usage method of claim 15 wherein said cavity is made at least substantially air tight, at least in part by the housing, and the exterior surface of the housing contacts the retainer from within the channel.

17. The kinesthetic speaker usage method of claim 16 wherein the housing is air tight with sound and vibration directed through the exterior surface by the operation of the speaker.

18. The kinesthetic speaker usage method of claim 1 wherein the speaker is wirelessly connected to an audio source, and the retainer is one of a solid and a foam construction.

19. The kinesthetic speaker usage method of claim 1 wherein said cavity is made at least substantially air tight, at least in part by the housing.

20. The kinesthetic speaker usage method of claim 19 wherein the housing is air tight with sound and vibration directed through the exterior surface by the operation of the speaker.

* * * * *